US005813174A

United States Patent [19]

Waller

[11] Patent Number: 5,813,174

[45] Date of Patent: Sep. 29, 1998

[54] CLOSET VAULT

[76] Inventor: James E. Waller, 2100 Brickell Ave. HCR 77, Box 161, Altamont, Tenn. 37301

[21] Appl. No.: 623,408

[22] Filed: Mar. 28, 1996

[51] Int. Cl.[6] ..... E04H 1/00

[52] U.S. Cl. ..... 52/79.1; 52/36.1; 312/265.3; 109/78

[58] Field of Search ..... 52/79.1, 79.6, 52/79.9, 79.12, 36.1, 745.02, 745.13, 745.16, 653.2, 656.1; 109/78, 79, 80, 82, 84, 85, 87; 312/265.3, 265.4

[56] References Cited

U.S. PATENT DOCUMENTS

| | | | |
|---|---|---|---|
| 4,154,031 | 5/1979 | Williamson, Jr. | 52/100 |
| 4,443,992 | 4/1984 | Shechter | 52/745 |
| 4,748,790 | 6/1988 | Frangolacci | 52/809 |
| 4,787,181 | 11/1988 | Witten et al. | 52/79.1 |
| 4,973,110 | 11/1990 | Nyquist | 312/265.3 |
| 4,998,388 | 3/1991 | Englehart | 52/36.1 |
| 5,012,621 | 5/1991 | Power et al. | 52/79.1 X |
| 5,239,792 | 8/1993 | Avni | 52/79.1 |
| 5,257,440 | 11/1993 | Bardou et al. | 24/287 |
| 5,315,794 | 5/1994 | Pearson | 52/79.1 |
| 5,319,903 | 6/1994 | Holland | 52/79.1 |
| 5,383,723 | 1/1995 | Meyer | 312/265.4 |
| 5,421,647 | 6/1995 | Simons | 312/265.4 X |
| 5,467,562 | 11/1995 | Holland | 52/79.1 |

FOREIGN PATENT DOCUMENTS

| | | | |
|---|---|---|---|
| 4308874 | 9/1993 | Germany | 52/79.1 |

*Primary Examiner*—Carl D. Friedman
*Assistant Examiner*—Creighton Smith
*Attorney, Agent, or Firm*—Waddey & Patterson; I. C. Waddey, Jr.

[57] ABSTRACT

A strong, light-weight steel structure which consists of individual tubular and bent-plate channel modules which are packaged and shipped loose and which are assembled by the user or a contractor to form a vault or enclosure, preferably rectangular in shape, with a lockable access door. The tubular and channel modules are designed and shaped for assembly within an existing structure and can in fact, be assembled entirely from the inside without access to the outside of the structure so that the system can be installed in an existing enclosure of the same size and shape as the assembled vault.

The modules can be screwed or bolted together from the inside so as to form a steel beam structure of substantial strength. The structure can provide protection for occupants against collapse or disintegration of a building structure because of wind storms, tornados, seismic events, and the like.

26 Claims, 16 Drawing Sheets

CLOSET VAULT

BACKGROUND OF THE INVENTION

The present invention relates generally to a housing module and more particularly to a closet unit for installation in a preexisting structure or for incorporation into a new structure, said closet unit structured in a manner to serve as both a closet and a vault or a safe harbor enclosure within a house, similar dwelling structure or other building.

The present invention will be described as a "closet-vault", meaning a structure that can serve multiple functions, including the function of a closet, the function of a vault, the function of a natural disaster shelter area, or the like; it being understood that the advantages and benefits of the present invention are many and multi-faceted.

The present invention will also be described as a modification or a retrofit of an existing house. However, it is understood that the structure can be built as a part of new home construction. It will be further understood and appreciated by those skilled in the art that when the present invention is described as a retrofit or a modification of an existing house, the invention could be installed in any dwelling structure such as an apartment, condominium, townhome, or the like, and the invention can also be installed in non-dwelling structures such as an office building, factory, warehouse, school building, church building, or any commercial or retail establishment.

It will be still further appreciated by those skilled in the art that structural steel tube and bent light-gauge steel structural panels have been successfully employed for many purposes and applications, such as for structural walls, floors, roof framing and buildings, and in construction of automobile, aircraft and boat components, catwalks, stair treads, shelving, utility closets and furniture. These structural components and the means to provide connectivity between them and other components are widely available and in current use in construction.

Vaults and protective enclosures have also been in existence for centuries; they currently exist in many forms in businesses, residences, banks, and government facilities. Typically, these types of enclosures are either totally constructed on site using welded steel or reinforced concrete materials, or they are entirely fabricated in a manufacturer's plant and shipped as a finished unit to the site.

The problem with the prior art vault and protective enclosures is that it is practically impossible to install them as a modification of an existing structure without demolishing a major portion of the existing structure. Further, for those type vaults and protective enclosures made of reinforced concrete materials, to build the forms and pour the concrete requires construction of footings to support the weight of the concrete and therefore must generally be at ground level. The weight of such structures can cause damage to the existing structure into which they might otherwise be installed and therefore retrofitting an existing structure with a vault or protective enclosure is cumbersome at best and impossible in many situations. Moreover, the cost of attempting to retrofit an existing structure with a secure vault or protective enclosure can be extremely expensive, time consuming, burdensome and destructive of the environment into which the system is to be installed.

What is missing in the prior art is a vault or protective enclosure that can be shipped in a compact packaging arrangement to the site of installation, installed as a retrofit of an existing structure on site, installed without having to destroy or make major modifications to the structure into which the system is installed, be installed at a minimum of time and expense and yet be secure against outside intrusion either by way of natural disaster or human intervention. Such a structure is presently unavailable.

SUMMARY OF THE INVENTION

The present invention is a strong, light-weight steel structure which consists of individual tubular and bent-plate channel modules which are packaged and shipped loose and which are assembled by the user or a contractor to form a vault or enclosure, preferably rectangular in shape, with a lockable access door. The tubular and channel modules are designed and shaped for assembly within an existing structure and can in fact, be assembled entirely from the inside without access to the outside of the structure so that the system can be installed in an existing enclosure of the same size and shape as the assembled vault.

The modules can be screwed or bolted together from the inside so as to form a steel beam structure of substantial strength. The structure can provide protection for occupants against collapse or disintegration of a building structure because of wind storms, tornados, seismic events, and the like.

The enclosure can be shielded to protect occupants from direct exposure to high voltage electricity caused by lightning or other external sources, provides a place of refuge against attack by intruders and includes means for contacting authorities or others by phone for help. The vault also provides a theft resistant enclosure for storage of firearms and valuables and a fire resistant enclosure for valuable documents and possessions.

The invention may be installed and used as a stand-alone structure, as a closet which is built into a building during original construction, as a closet which is added within an existing room, or as a retrofit liner to an existing closet space. For all of these options, the invention is designed with holes properly located for anchoring the protective structure against sliding, overturning and uplifting, for adding additional impact resistance and/or fire resistance to enclosure walls, ceiling and floor, and for grounding the enclosure for electricity conducted by lightning or other sources. None of these options require special configuration of the invention.

The invention incorporates protective steel panels on top, sides, and bottom of the protective enclosure and is equipped with a pre-hung, fire resistant door which meets federal handicapped accessibility requirements, pick-resistant locking devices, and panic-type opening hardware, door closer, peek hole, and theft resistant, piano-hinge hardware. As an option, a bullet-resistant door and adjacent jam panels may be included.

The invention is equipped with an externally supplied 110-volt electrical hook-up and junction box with transformer to a 12-volt circuit which powers interior fixtures such as lights, fan, burglar alarm, cellular phone, etc. and which is backed by an instantaneous battery back-up power supply. Pre-punched holes in each structural module of the enclosure provide uninterrupted paths for routing electrical wiring throughout the enclosure walls, floor, and roof or ceiling.

The invention provides for the support and attachment of hardwood or plywood flooring and gypsum board or wood panels on wall surfaces or ceilings and for the addition of user selected thermal insulation within the ceiling walls or floors. Enclosure surfaces and floor covering used elsewhere in the building may also be used for the finish of the interior of the closet vault of the present invention. The door surfaces can be painted or bonded with wood veneer to match other doors.

The invention may also be equipped with antenna leads for the through wall transmission of cellular telephones and other emergency signal, expansion anchors for connecting the invention to concrete surfaces or steel eye bolts for connecting the closet vault to tie-down hardware for first floor installation over a crawl space.

DESCRIPTION OF THE PREFERRED EMBODIMENT

Figure 1A:
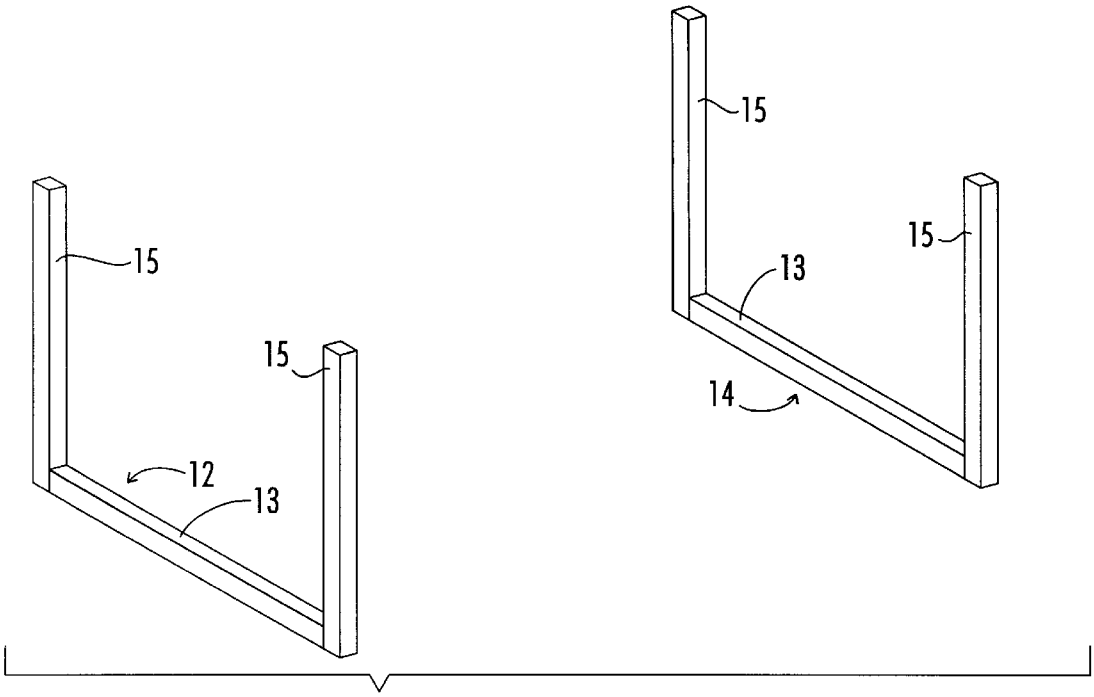
FIGS. 1–5 show the sequence of assembly of the tubular frame of the closet vault.

Applicant's invention will be best understood by reviewing the following description of the preferred embodiment of the invention, made in conjunction with the attached drawings, wherein like reference numerals refer to like parts.

Applicant's closet vault is packaged and shipped as a compact pre-fabricated assembly designed for on-site assembly and installation. FIGS. 1–5 illustrate the sequence of assembly of the "frame" of the closet vault to which the modular wall, floor and ceiling/roof elements (enclosure panels) are attached. This frame provides a tubular skeleton for the closet vault and is constructed of pre-formed, pre-punched, tubular elements. The frame includes snap in connectors to facilitate the assembly of the frame and matched, pre-punched screw holes and utility holes which enable the tube assembly to be stably connected during each step of its assembly.

Figure 12:
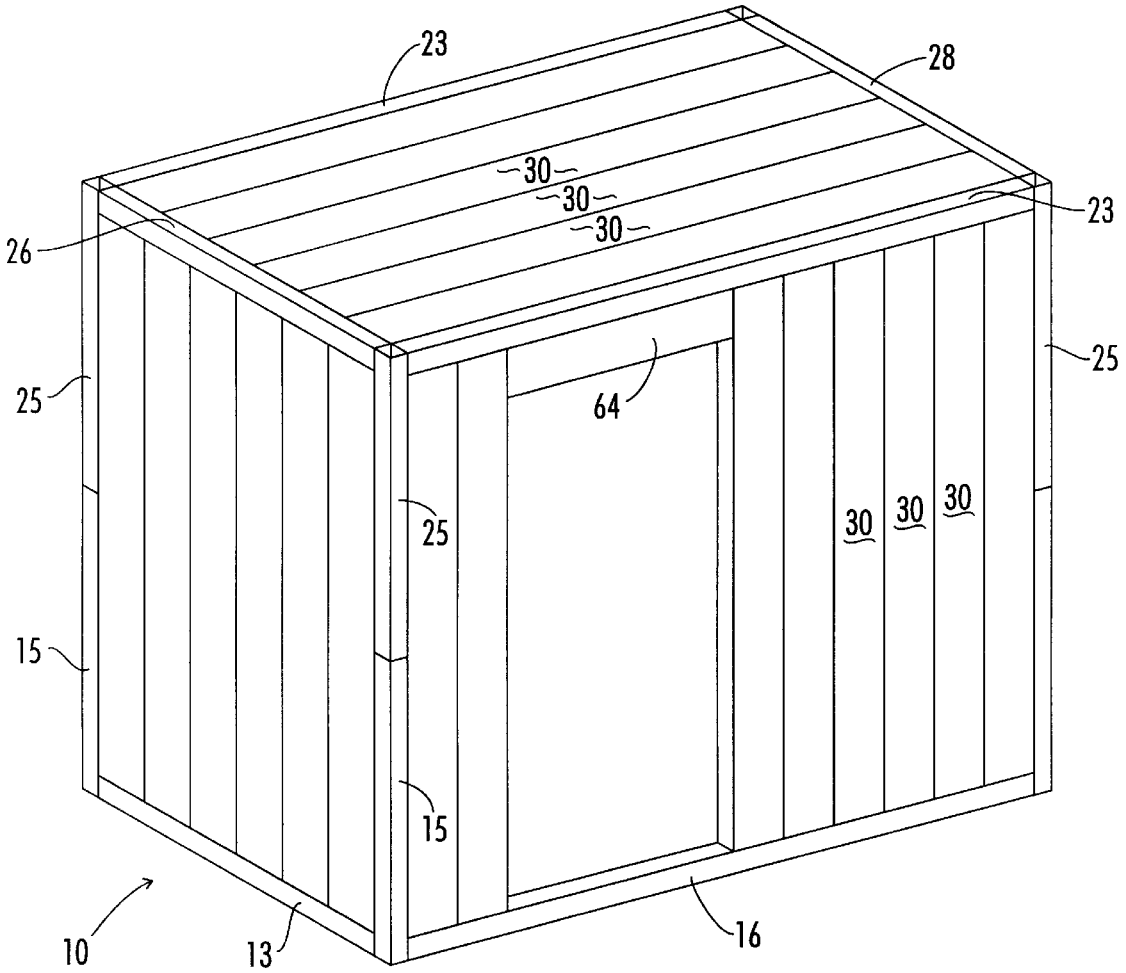
FIG. 12 is an exterior view, in perspective of the completely assembled enclosure except for the door.

FIG. 12 illustrates the closet assembly 10 in perspective view as completely assembled and free standing except for the door. The assembly of the unit, as can be seen from FIGS. 1–5 occurs by placing the bottom U-shaped tube assemblies 12, 14 on a floor or other flat surface of the area where the closet vault is to be assembled. The lower U-shaped tube assemblies are, in the preferred embodiment, constructed of a square, steel tube or beam, generally elongated and hollow. The assemblies each include a base 13 and a leg 15 connected to each end of the base and extending perpendicularly upwardly from the base.

Figure 1B:
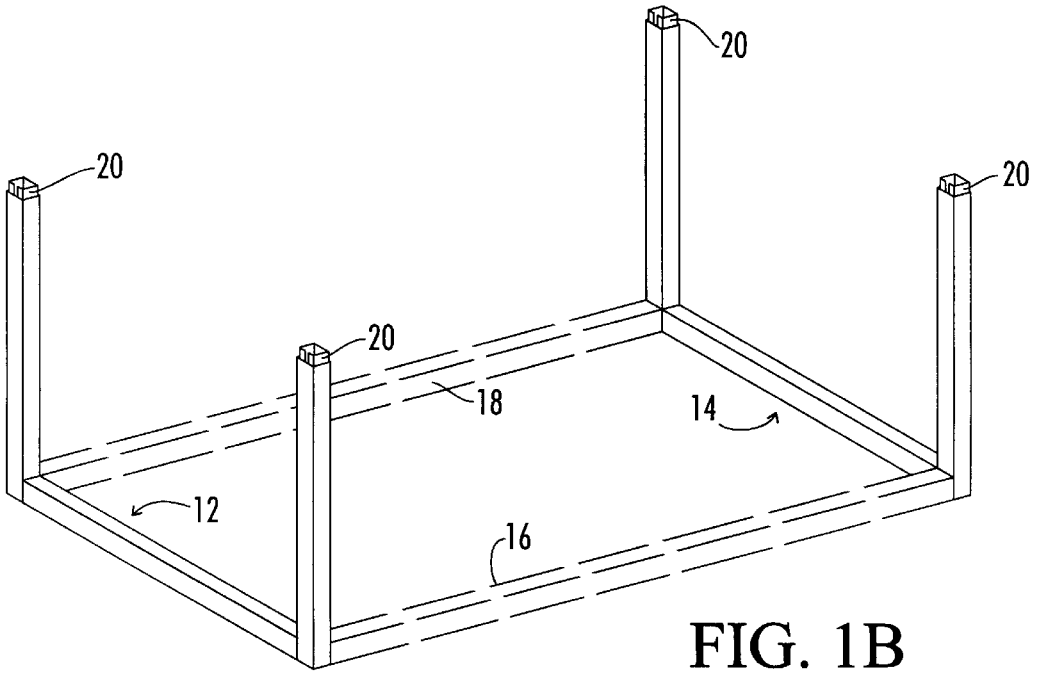

Once the bottom U-shaped assemblies 12 and 14 have been placed in the proper environment, the bottom U-shaped assemblies are connected by the bottom tube sections 16, 18 shown in phantom lines in FIG. 1B. The bottom tube sections 16, 18 are also, in the preferred embodiment, square, elongated, hollow tubular steel beams which provide strength and rigidity to the system. Once the bottom tube section 16, 18 have been attached (using the connector as described in more detail hereinafter), snap-in vertical tube connector sleeves 20 are snapped into the open top of each of the legs 15.

Figure 2A:
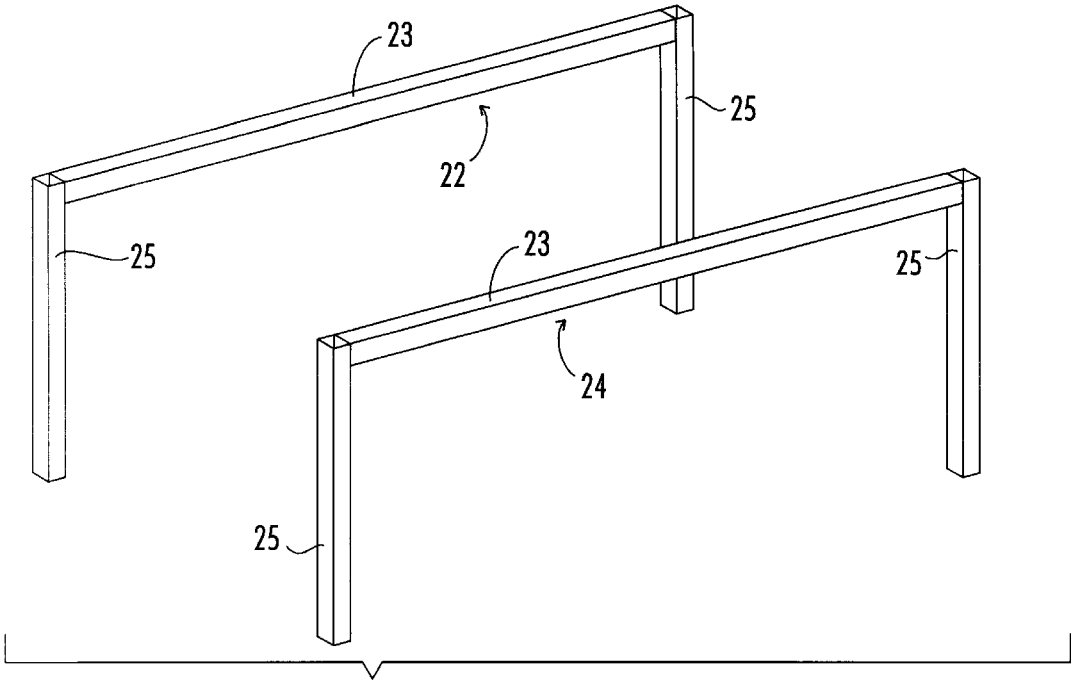
Figure 2B:
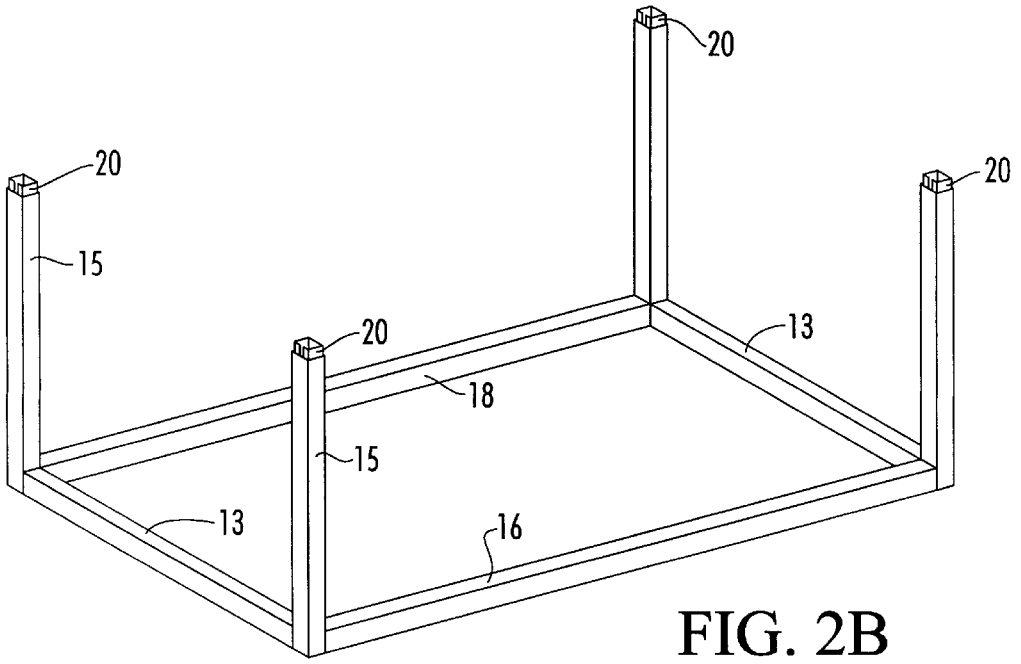
Figure 3:
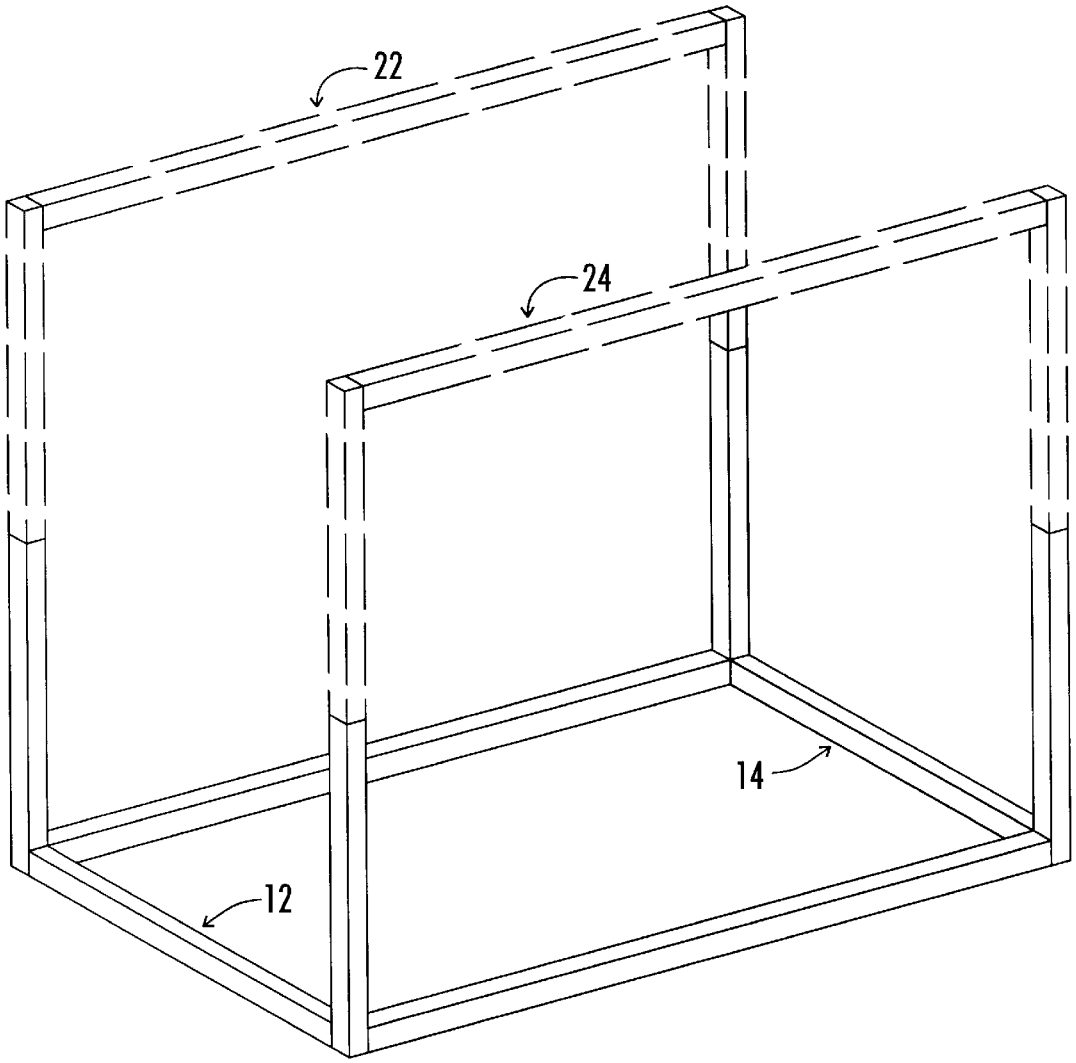
Figure 4:
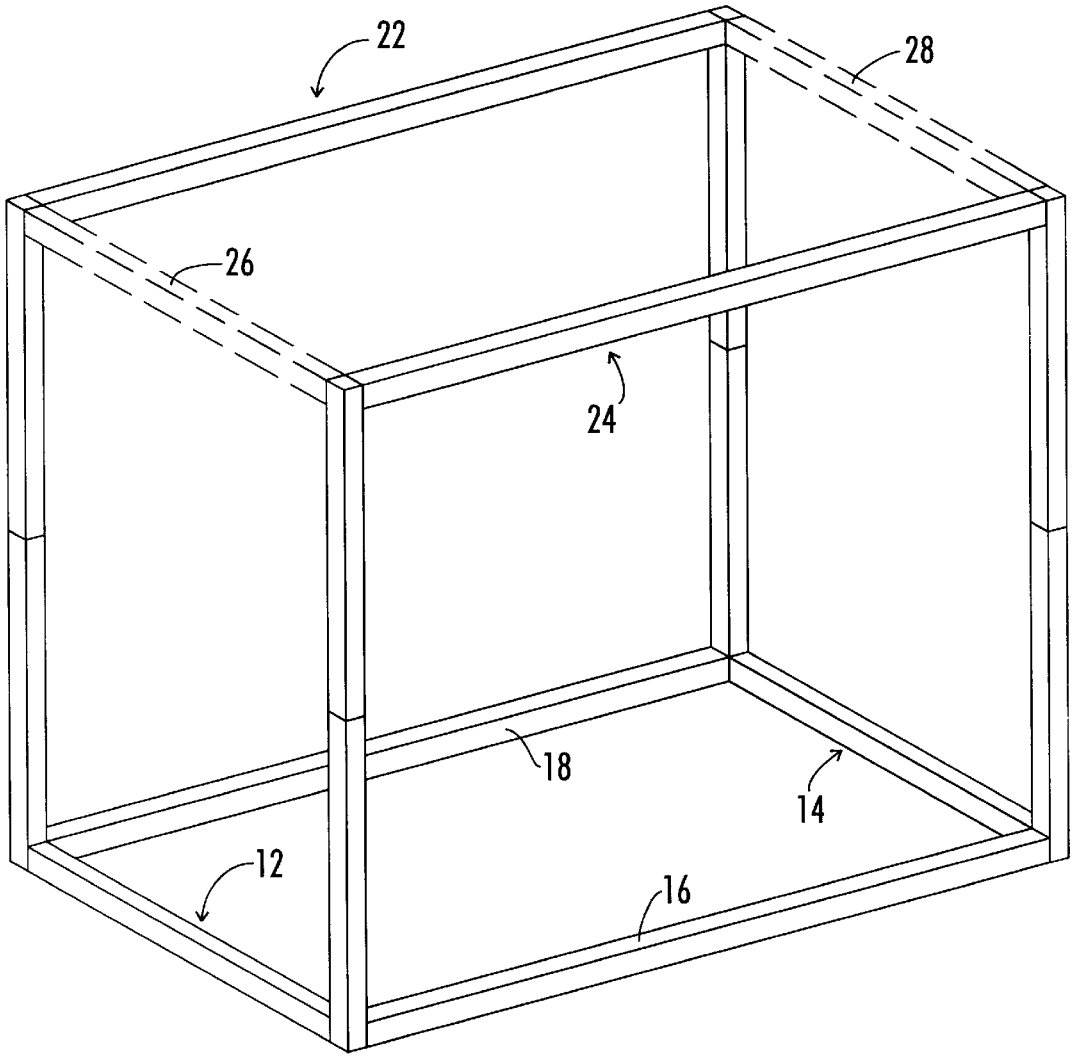
Figure 6:
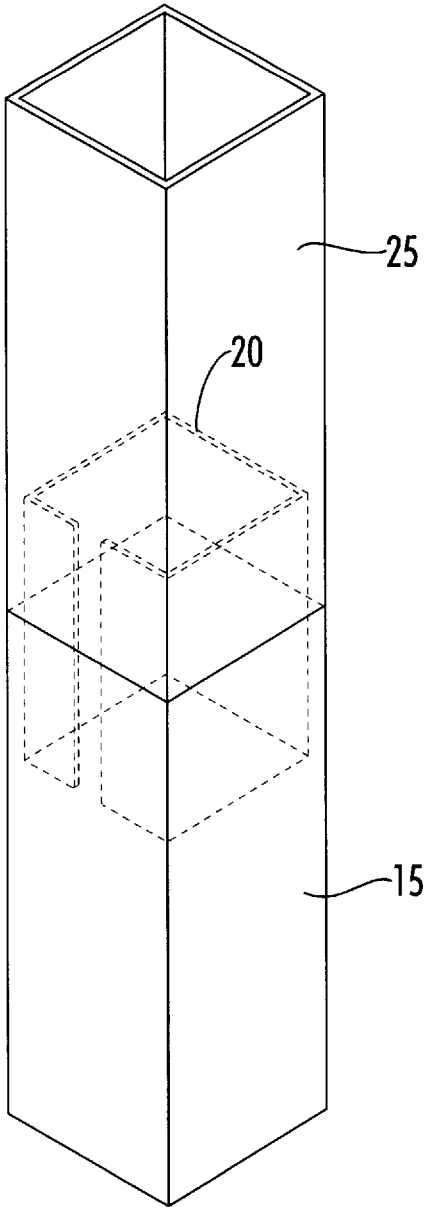
FIG. 6 is a perspective view of the connection of the top tubular steel frame assembly to the bottom tubular steel frame assembly via the inserted bent plate sleeve.

Referring now to FIGS. 2A and 2B, the upper U-shaped assemblies 22, 24 are illustrated with each having a base 23 and depending legs 25. The upper U-shaped tube assemblies are formed of the same material as the lower U-shaped tube assemblies, and the upper U-shaped tube assemblies are lowered into position with the legs 25 being in registry with the legs 15 and the legs 25 fitted over the snap-in vertical tube connector sleeves 20 as is illustrated in FIG. 6. FIG. 3 illustrates the upper U-shaped tube assemblies 22, 24 connected to the bottom U-shaped tube assemblies 12, 14 and FIG. 4 illustrates the completion of the frame by the insertion of top tube sections 26, 28 to connect the elbows of the upper U-shaped tube assemblies.

FIG. 6 illustrates in more detail the snap-in vertical tube connector sleeve 20. Sleeve 20 is a short segment of bent metal generally square in cross section, but having a gap in at least one end in order to provide some flexibility to the sleeve. Pre-fabricated snaps, indicated generally as squares on the various plane surfaces of the drawings, can either be square, round or other shaped raised embossments in the sleeve; said snaps designed to engage square, round or other similarly shaped mating holes in the thicker plates of the tubing. The embossments fit into the holes when the connection is in the correct position. Contact surfaces of the snap-in bent plate sleeves 20 and the inside walls of the lower vertically extending legs 15 and/or the upper vertically extending legs 25 may be glued prior to insertion or may be connected with screws. However, neither glue nor screws are required to connect the vertical legs of the U-shaped tube assemblies to render the frame stable during or after assembly.

Figure 5:
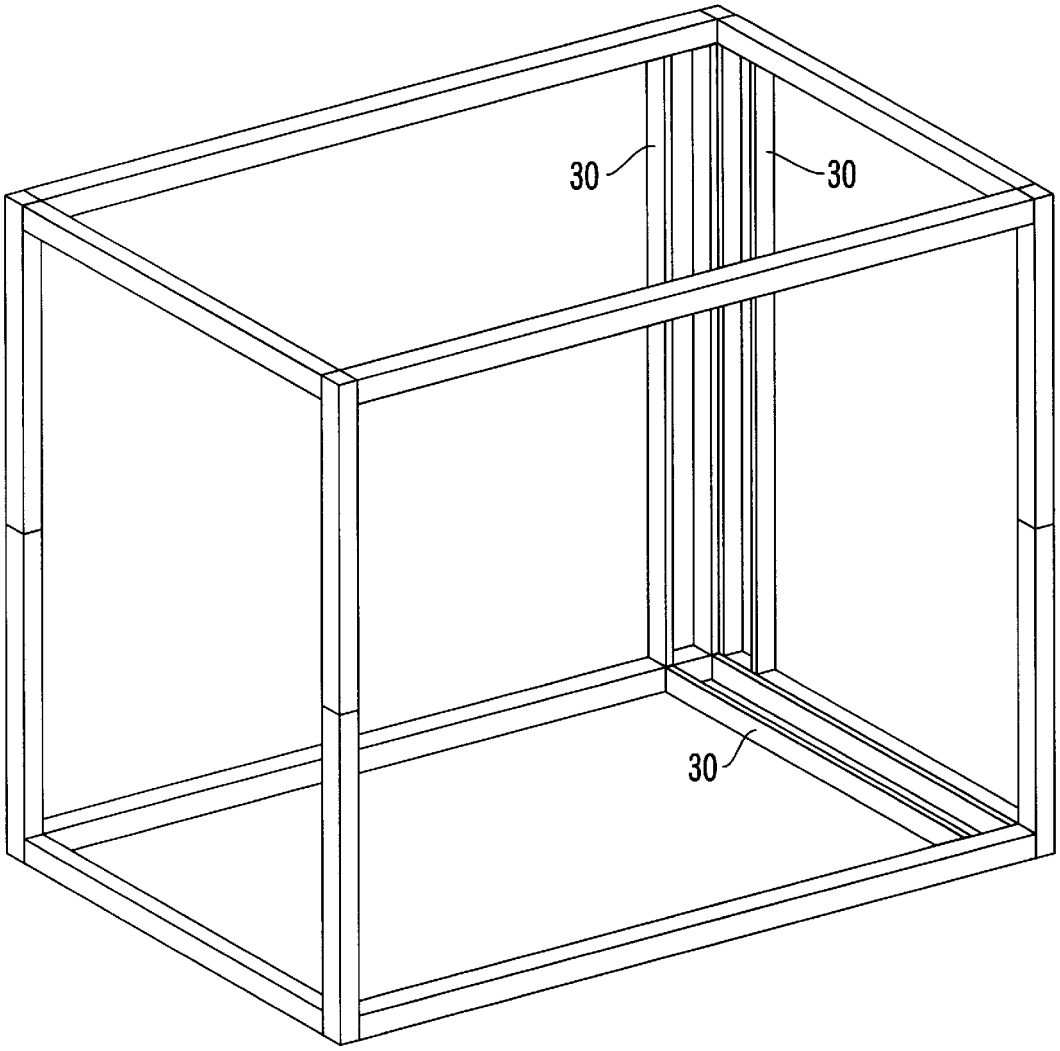

FIG. 5 illustrates the assembled frame with the three bent plate C-shaped panels 30 assembled to the frame to begin completion of the closet vault.

Figure 7:
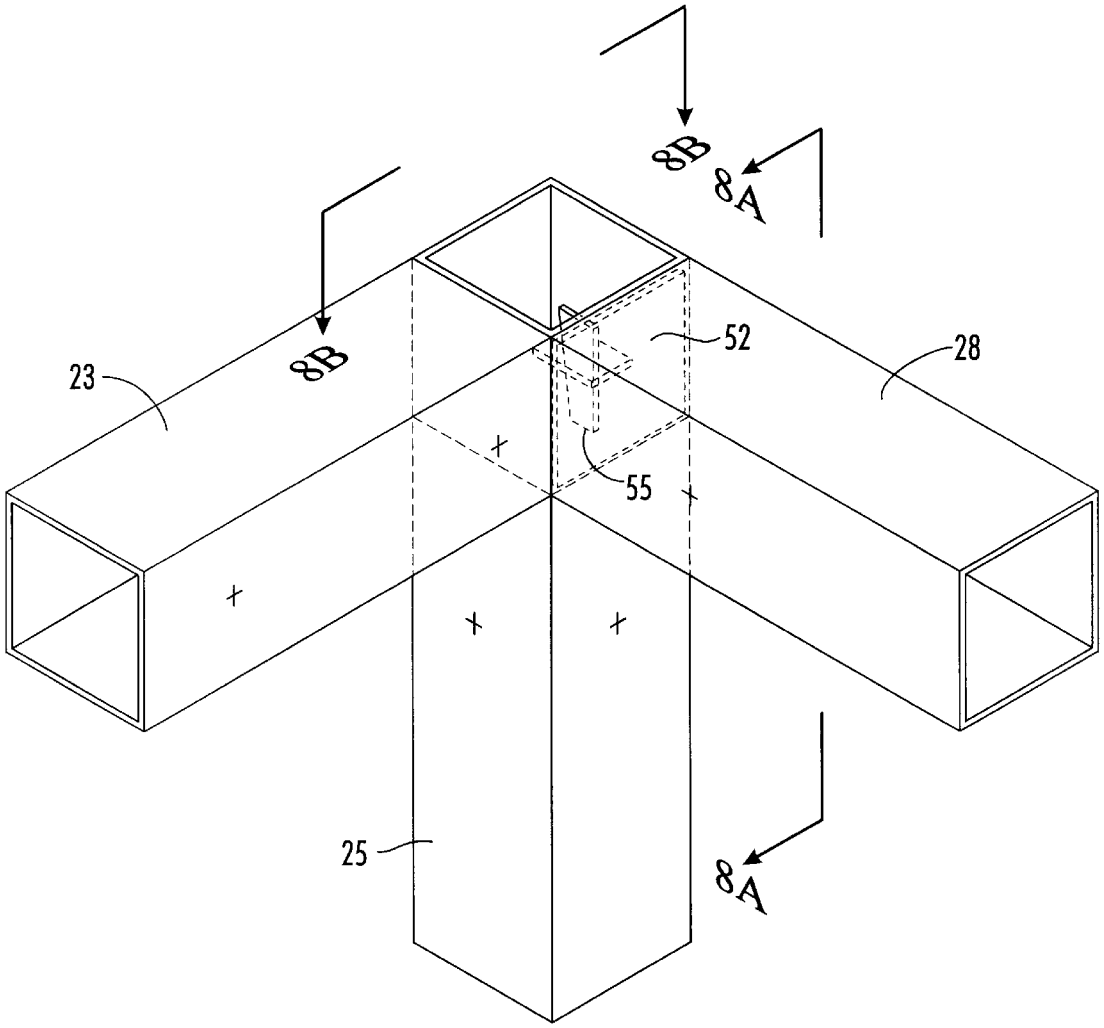
FIG. 7 is a perspective view of the connector for connecting tubular frame elements.

Referring now to FIG. 7, there is illustrated the method of connecting the tube sections of the frame to the U-shaped tube assemblies. The upper and lower tube sections are connected to the upper and lower U-shaped tube assemblies in the same manner and the description and illustration of FIG. 7 are of the assembly of the upper unit. As can be seen from FIG. 7, the base 23 has leg 25 attached and extending perpendicularly therefrom and the tube section 28 is connected to the side of the U-shaped tube assembly at the point where the base 23 and the leg 25 join.

Figure 8A:
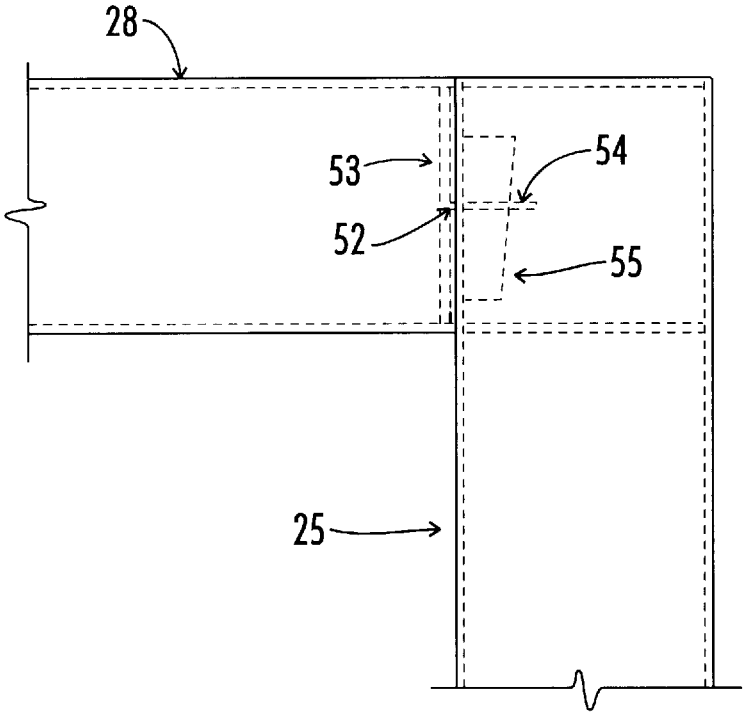
FIG. 8A is a cross sectional view taken along the line 8A—8A of FIG. 7.
Figure 8B:
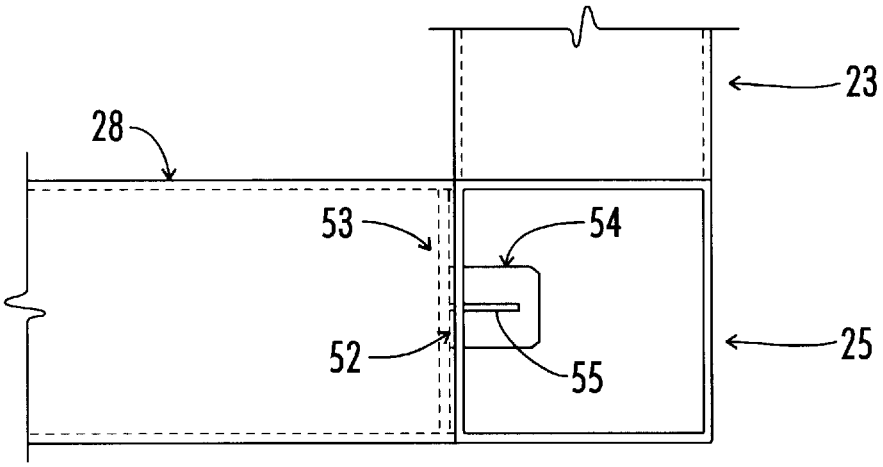
FIG. 8B is a cross sectional view taken along the line 8B—8B shown in FIG. 7.

Referring now to FIGS. 8A and 8B, the tube section 28 is provided with a welded plate connector 52 which includes a base 53 and a slotted tongue 54. Base 53 is generally square in cross section and is welded to the insides of tube 28. The slotted tongue 54 is welded to the base 53. During assembly the slotted tongue 54 is inserted through a rectangular slot in one face of the tube 25. The connection is secured by inserting the wedge shaped key 55 through the slot of the slotted tongue 54 and firmly seating the key 55 in the slot by tapping with a hammer or other tool. The outside surfaces of base 53 may also be glued to the face of the tube 25 to create a more secure connection, but the Applicant has found that the wedged key and slotted tongue arrangement is adequate for stability and strength during and after assembly of the unit.

As can be seen from FIG. 4, the upper U-shaped tube assemblies 22 and 24 must be spread apart in order to insert the slotted tongue 54 at each end of the tubes 26, 28 through slots in the intersected tubes 25. U-shaped assemblies 22, 24, FIG. 3, are easily spread apart by manually applying nominal force between the elbows of the two U-shaped assemblies 22, 24. The inserted tubes 26, 28 are held in position by the flexural spring of the tube assemblies 22, 24 after the nominal force is removed until the connection is secured by installation of the wedge shaped key 55 at each intersection. It should be understood that the order of assembling the tube frame may be reversed. If it is more convenient to the assembler, the upper tube frame assembly 22, 24, 26, 28 may be completed before the upper tube frame is connected to the lower tube frame using the snap-in tube connector sleeves 20.

Once the frame has been assembled to the point illustrated in FIG. 4, the side, floor and ceiling panels can be connected to the frame to complete the construction of the enclosure.

Figure 9:
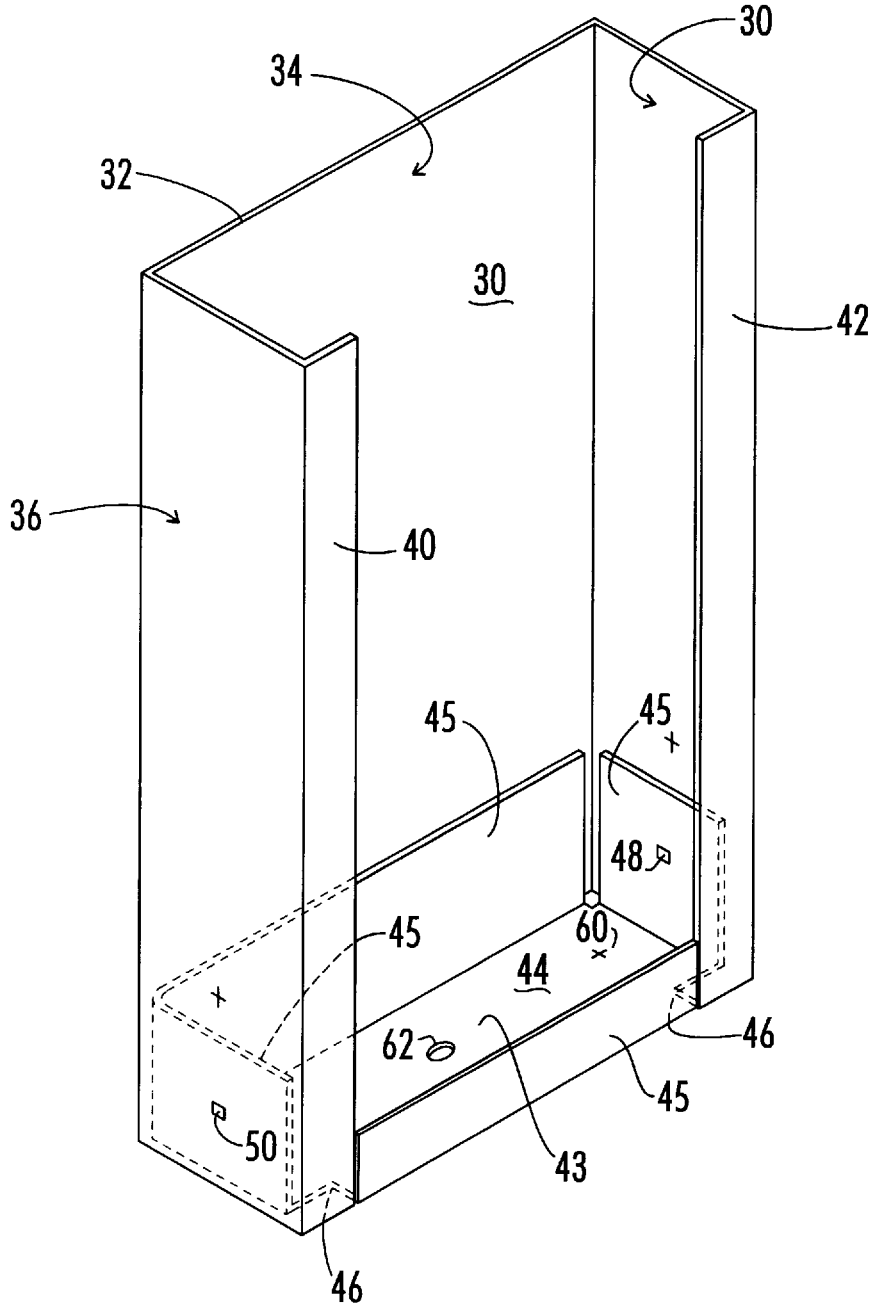
FIG. 9 shows in perspective view a snap-in bent plate connector fitted into one end of a C-shaped panel.

FIG. 9 illustrates more specifically the elements from which the sides, floor and ceiling are constructed and the means of assembling them to the frame. Specifically, as is illustrated in FIG. 9, the modular wall, floor and ceiling panels are individually assembled through the use of bent plate C-shaped panels 30 and snap-in bent plate connectors 44.

The panels 30 are made of bent or formed metal, preferably steel, for strength, stability and safety of the closet vault and to provide a solid enclosure. They have a C-shaped cross section 32 formed by a flat panel 34, channel arms 36, 38 with fingers 40, 42. The panels 30 are elongated having an open center and a channel between the fingers 40, 42 in communication with the open center so that the open centers of the panels can be accessed from the interior of the enclosure for connecting adjacent panels to each other by screws or similar connecting elements. A panel snap-in bent plate connector 44 is used to connect the end of panels 30 to the frame of the closet vault. The connector 44 has a base 43 and legs 45 extending perpendicularly from the base 43. The legs 45 have outer contact surfaces which are shaped and sized to mate snugly with the inner contact surfaces of the flat panel 34 and the channel arms 36, 38 of the panels 30. The front-most leg 45 of the connector 44 as shown in FIG. 9 fits between the fingers 40, 42 so that the connector 44 will fit securely within the open end of the panel 30. This leg 45 and the channel fingers 40, 42 provide continuous surfaces for attaching fire resistant wall board or wood panels on the interior surfaces of the enclosure using screws and, as an option, glue. A notch 46 is provided in the base 43 of the connector 44 so that the connector 44 will fit around the fingers 40, 42 of the panel 30.

Once again, embossments 48 are provided on the legs 45 and extend radially outwardly from the connector 44 to form snaps for engagement with holes 50 that have been punched or otherwise pre-formed in the channel arms 36, 38. Thus, when the connector 44 is properly seated within the open end of the panel 30, the snaps 48 will engage the holes 50 and securely lock the connector 44 in place.

Figure 10:
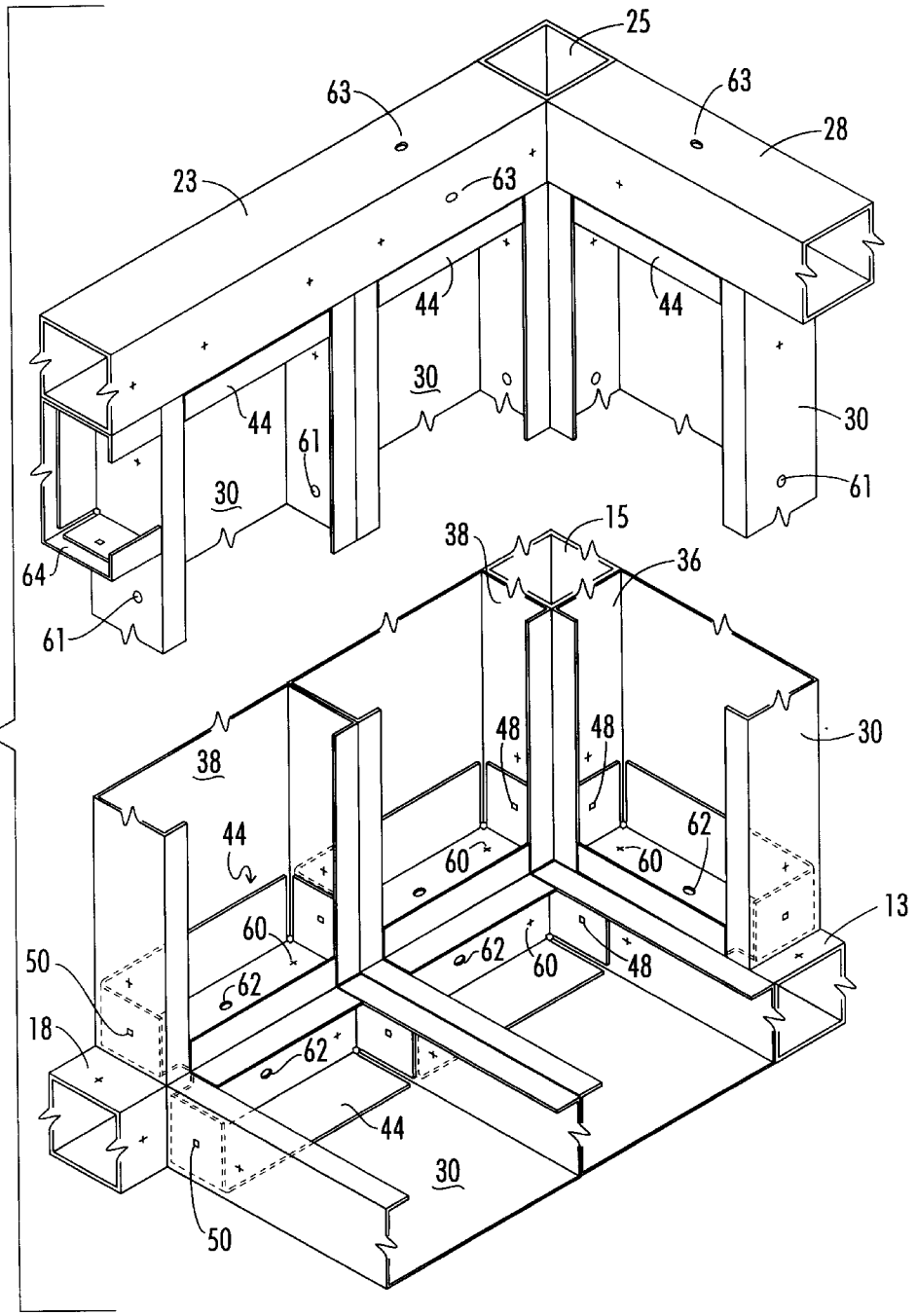
FIG. 10 is a perspective view of a portion of the tube assembly with wall and floor panels connected at a corner of the enclosure.

Turning now to FIG. 10, the assembly of the system is illustrated in cut-away and partial perspective. As can be seen from FIG. 10, multiple panels 30 are connected in side-by-side relationship to form the walls and the floor for the closet vault. Once the connectors 44 are snapped into the ends of the panels 30, the panels 30 are placed on the base 13 and the tube sections 16 and 18 and screws can be passed through the screw holes 60 to screw a panel fixedly to the base or tube of the lower portion of the frame. The channel arm 38 of a panel 30 will be attached via screws to a leg 15 or to channel arm 36 of an adjacent panel 30, and the opposing channel arm 36 will either be attached to channel arm 38 of an adjacent panel 30 or to a vertical leg 15. All of these connections can be via screws threaded into pre-punched holes to assemble the structure from inside the opening of the panel 30.

The assembly of adjacent panels 30 in side-by-side relationship to each other provides strength and rigidity to the system and gives it the structure of an eye beam which allows the structure to withstand significant forces created by natural phenomenon or attacks by potential intruder. On the upper end of the system, the connectors 44 inserted in the top end of the panels 30 are connected via screws passing through holes 60 into the base 23 and the tube sections 26 and 28 with multiple panels 30 attached in side-by-side relationship in the manner described above. The strength and rigidity of the assembled multiple panels 30 and enclosure frame may be substantially increased by gluing contact surfaces between each panel 30 and every surface contacted during installation of that panel.

Figure 11:
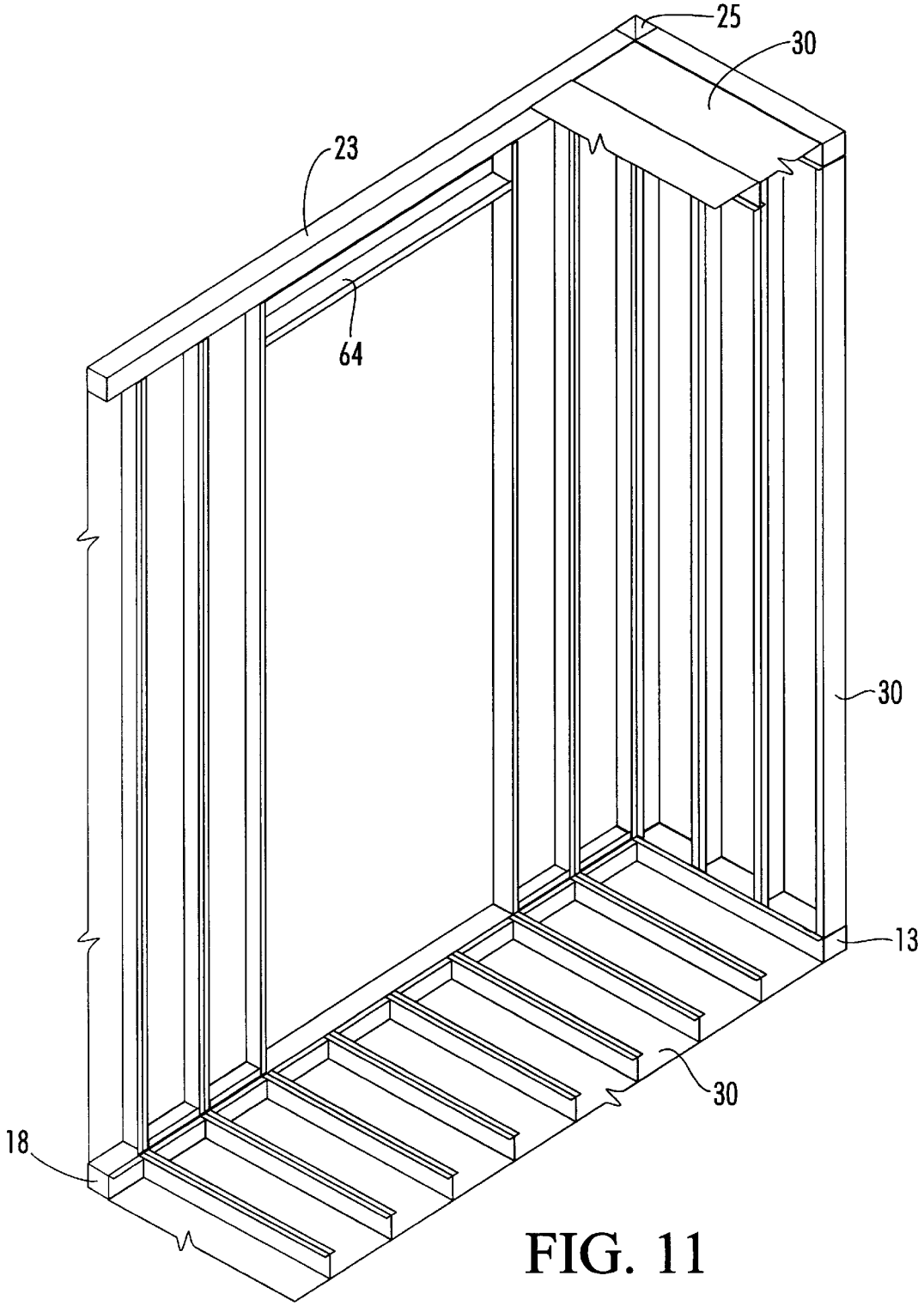
FIG. 11 is a perspective view in partial cross section of the assembled enclosure illustrating a ceiling panel and a door header panel.

A door header 64 can be formed by taking a panel 30 and turning it horizontally to connect between two adjacent panels 30 and to the upper base 23. Once the floor and side walls have been assembled, a roof or ceiling structure can be created for the closet vault using the same panels 30 attached to the interior face of the base 23 of each of the opposing upper U-shaped tube assemblies 22, 24. FIG. 11 illustrates the header of the door assembled in place along with one panel 30 in place to begin creation of the ceiling for the closet vault. With the side walls, floor and ceiling assembled, a completely enclosed steel structure is formed by six enclosure walls, each having the strength and rigidity of a solid wall panel reinforced by uniformly spaced eye beams which are capable of resisting high forces applied normal to the surface of the solid panel. Thereafter, plywood or other flooring material can be laid across the bottom beams to create a floor surface for the closet vault. The side walls and ceiling may be covered with gypsum board or other fire-proof material to complete the enclosure. The enclosure may also be provided with one or more electrical outlets, a light source and a battery powered system for providing light and power in the event of severance of the unit from external power sources. A cellular phone may also be provided within the structure to call for emergency help or to monitor information available in the event of a natural disaster.

A door may be mounted within the opening framed by the side panels and the header 64. The door can be connected with heavy-duty piano hinges to provide it with great strength and rigidity so that the occupants of the closet vault will be protected against any reasonable outside force or attempted intrusion.

FIG. 12 illustrates the assembled unit with flooring and gypsum board on the inside, but without any illustration of the door that would be provided for closure of the opening beneath the header 64. It should also be noted that multiple closet vaults can be built and attached in a side-by-side relationship with communication being between contiguous side wall chambers so as to expand the size of the closet vault and limit the access to it.

Figure 13:
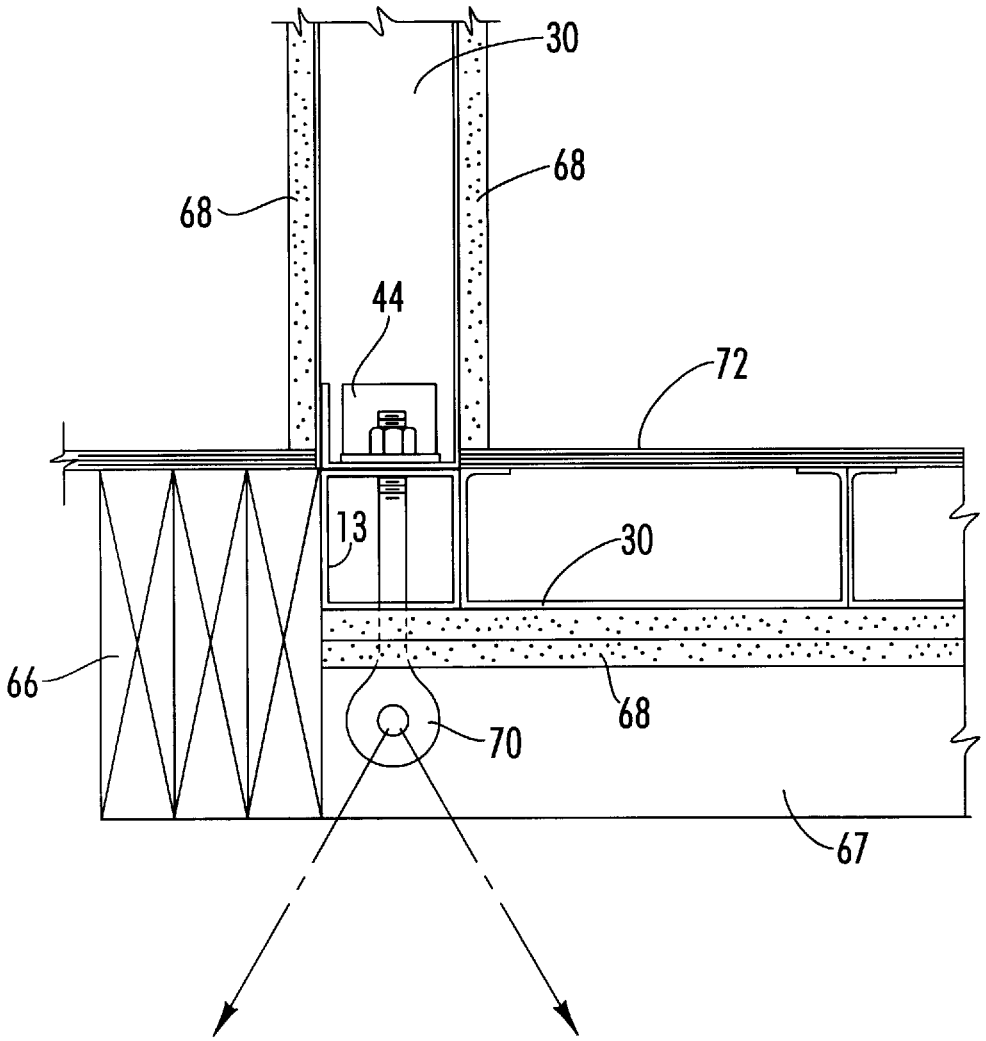
FIG. 13 is a partial cross section of a lower corner of the structure showing the unit anchored to wood framing by an anchor bolt.

FIG. 13 illustrates one method of erecting the closet vault on the floor framing of a building having an under floor crawl space. A lam-beam structure consisting of multiple 2×8, 2×10, 2×12, or other similar elements is illustrated with structural 2×4 supports extending from one lam-beam 66 to another (not shown). The bottom U-shaped tube assembly would sit on the 2×4's 67 and eye bolt 70 would be passed through pre-punched holes 62 in bent plate bottom end connectors 44 of wall panels 30 and through the tube 13 and connected with a metal plate washer and nut. Tension wires or other tie down devices could then be attached through the eye bolt to secure the enclosure against being lifted by either natural or man-created forces. The tension wires would be anchored to ground anchors or concrete dead men (not shown) to stably hold the closet vault in place. FIG. 13 also illustrates the proper location of fire resistant gypsum wall board 68 to provide fire resistant construction which is standard in the building industry and which has come to be universally accepted by fire testing and code enforcement officials. FIG. 13 also shows the plywood floor 72 installed in the closet vault.

Figure 14:
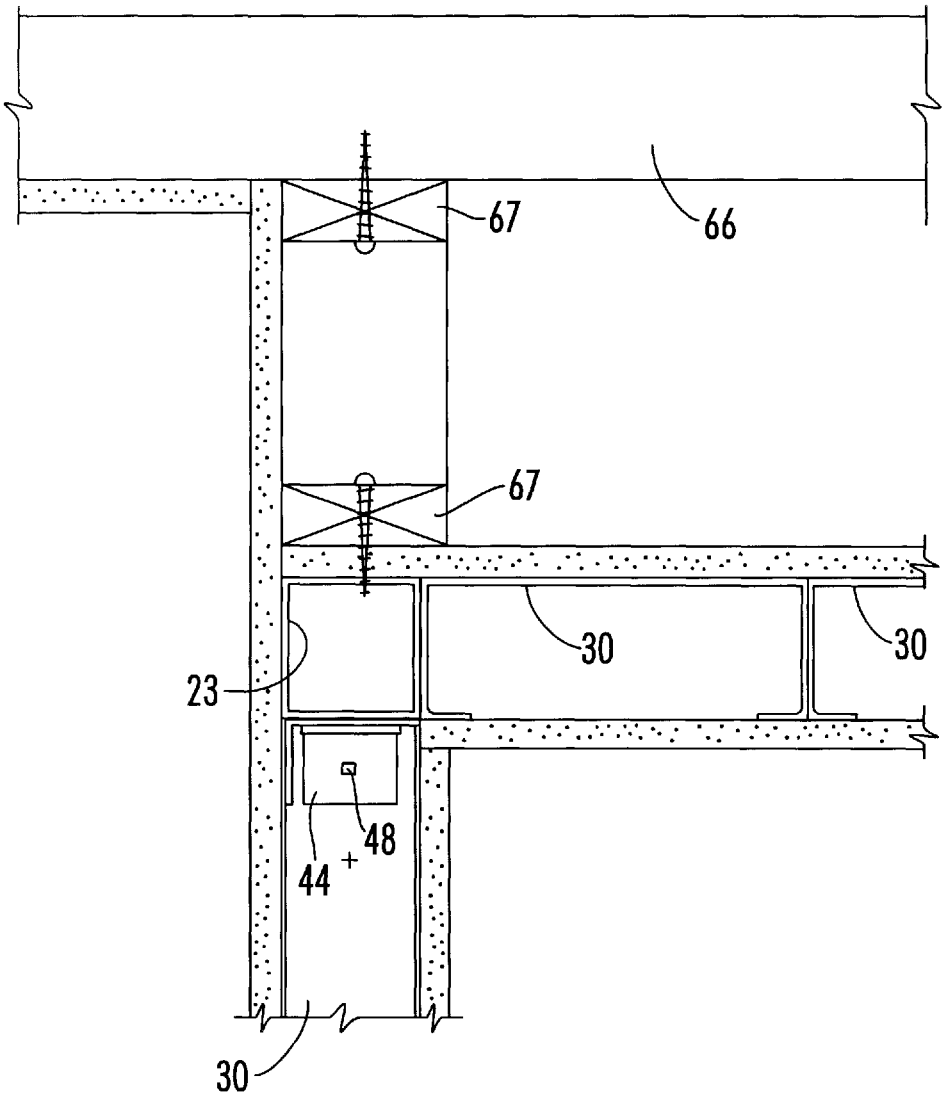
FIG. 14 is a partial cross section of the assembly unit showing fire rated gypsum board attached to the C-shaped panel.

Illustrated in FIG. 14 is the upper part of the enclosure with 2×4s 67 framed down from joist 66 or other similar ceiling structure or the underside of a concrete floor slab or the like. This figure also illustrates the proper placement of gypsum board to provide fire resistance for the enclosure.

Figure 15:
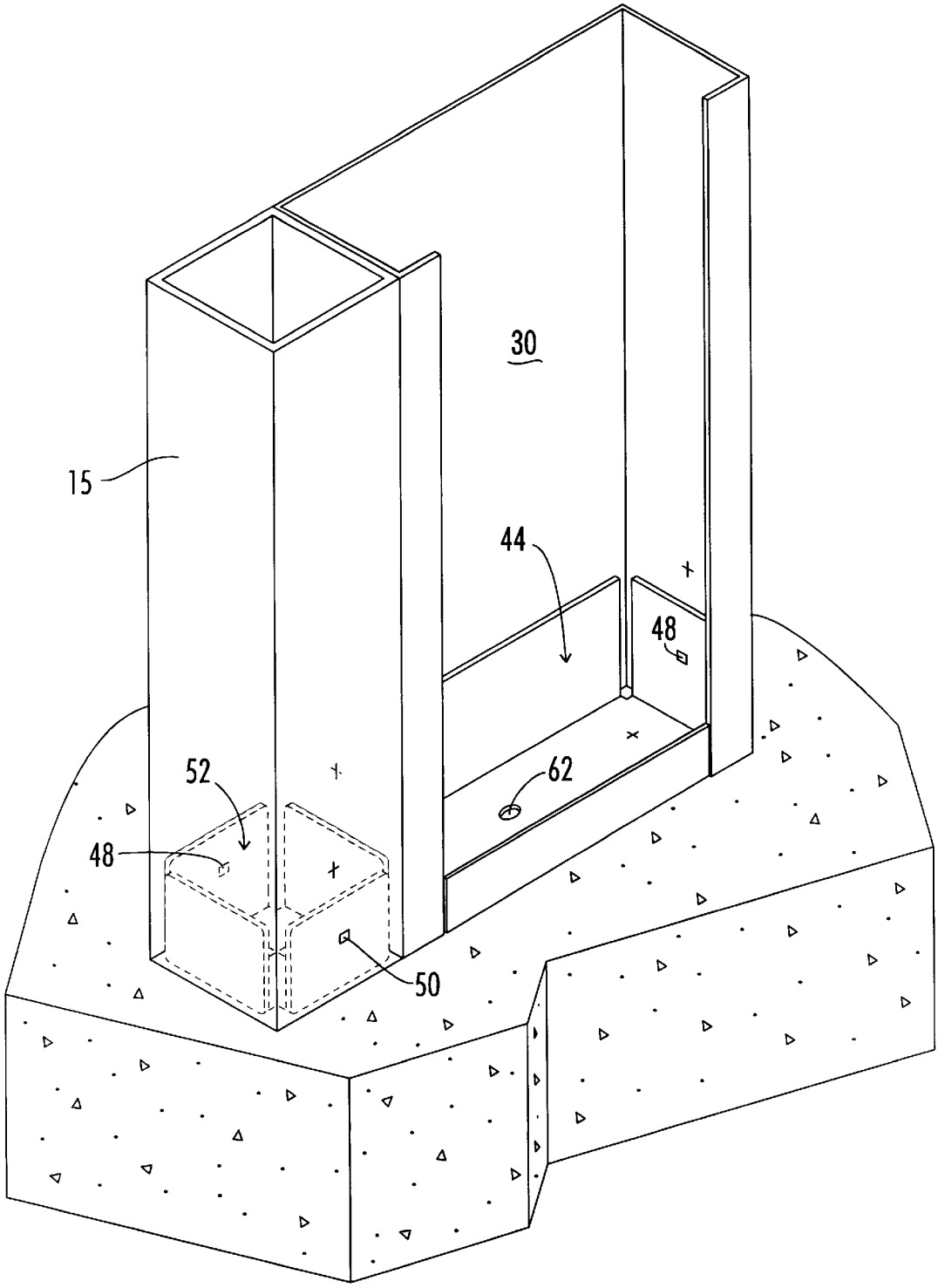
FIG. 15 illustrates the bottom of a tube assembly and wall panel in perspective attached to a concrete floor slab.

FIG. 15 shows an alternative construction of the closet vault that would be implemented when the structure is to be attached to a concrete slab. As can be seen from FIG. 15, the bottom end connector 44 of a wall panel 30 would attach directly to the concrete by concrete screws passing through screw holes 60 in the base of connectors 44. Frame element 15 would be connected using a special bent plate, snap-in connector 52 which would be pre-positioned and connected to the concrete floor with an expansion anchor bolt in a drilled hole. Contact surfaces between connectors 52 and the inside walls of the tube frame element 15 would be glued or, alternatively, the connection would be made by screwing element 15 to the vertical plates of the connector 52. The horizontal base of the structure would be eliminated so that the panels and vertical tubes can be attached directly to the concrete via concrete screws or expansion anchor bolts.

Figure 16A:
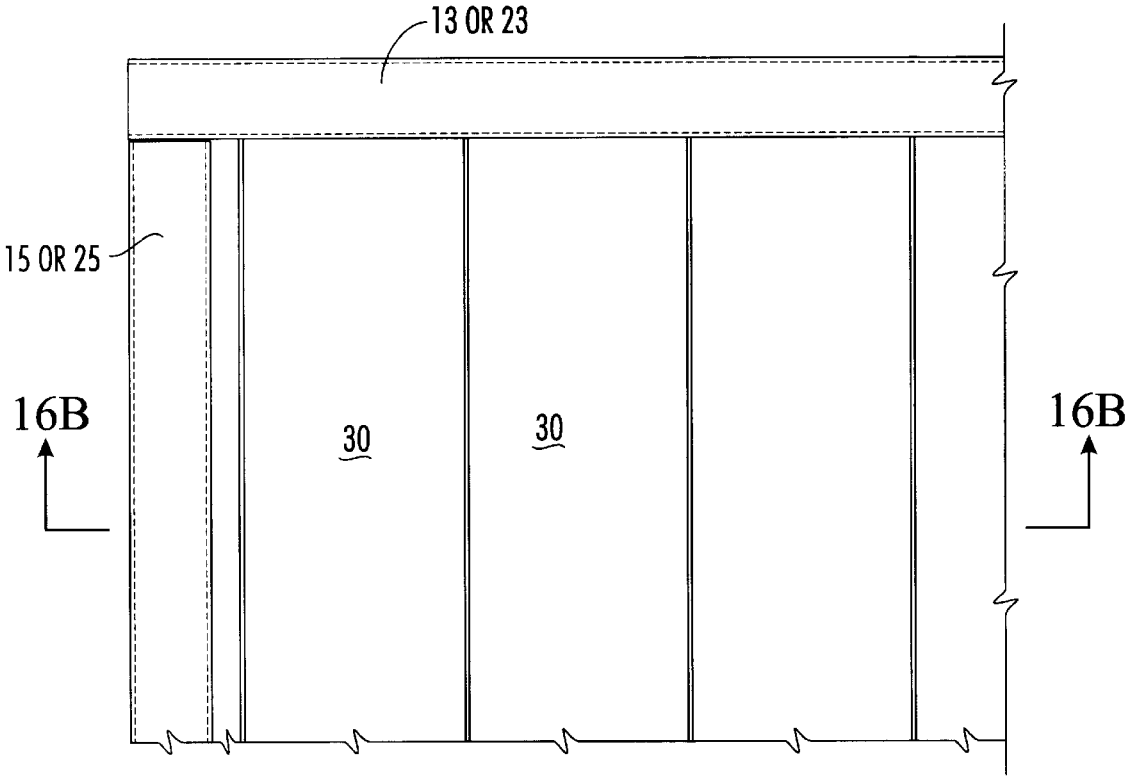
FIG. 16A–16B illustrates the unassembled module panels and tube assemblies positioned for compact packaging.
Figure 16B:
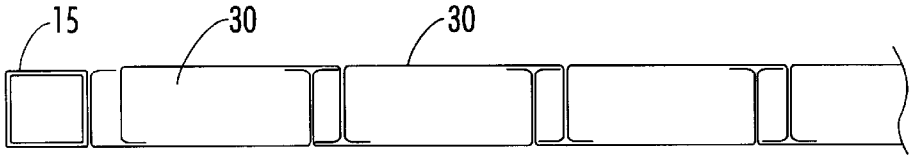

FIG. 16A and 16B show the unassembled modular panels and the tube assemblies positioned for compact packaging and shipment. FIG. 16B shows a bottom layer of modular panels 30 on top of which a second layer of inverted modular panels 30 has been placed so that the two layers occupy nearly the same thickness as a single layer of panels. Pre-fabricated U-shaped tube assemblies 12, 14, 22, 24 form the perimeter of the package and provide protection for the corners of the bundle and means for handling the bundle for shipment. "Compressibility" for storage and shipping is a significant feature of the invention. Uniform and compact packaging of modular elements of the enclosure allows use of simple and economical lifting and handling equipment, permits economical stacked storage, loading, and transport, and permits protected bundles to be transported in self-contained and easily handled sizes from manufacturing plant to place of assembly without breaking down bundles during transit.

Although there have been described particular embodiments of the present invention of a new and useful closet vault, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A pre-fabricated metal closet vault including multiple pre-fabricated, sized and shaped elements designed to facilitate on-site assembly, including:

a. multiple framing elements, each framing element constructed of metal and having two free ends;

b. connectors connecting facing free ends of adjacent framing elements to form a frame defining a ceiling, floor and sides, said ceiling, floor and sides connected to form a closet vault having an inside area;

c. elongated metal panels attached to said frame in side-by-side, juxtaposed relationship to form a metal ceiling, side walls, and floor of said closet vault;

d. said panels having an open center defined by opposing channel arms with said channel arms sized and shaped whereby each channel arm mates with the channel arm of an adjacent panel and with said frame;

e. said channel arms providing access to said open center of said panels with each panel connected to an adjacent panel by fasteners attached from the inside area defined by the side walls, ceiling and floor of the closet vault; and f. a door opening in one of said walls of said closet vault.

2. The closet vault of claim 1 wherein said panels have a C-shaped cross section.

3. The closet vault of claim 1 wherein said framing elements are constructed of square metal tubing.

4. The closet vault of claim 1 wherein said framing elements and said panels are formed of steel.

5. The closet vault of claim 1 further including fingers connected to said channel arms.

6. The closet vault of claim 5 wherein said fingers of each channel arm extend toward each other with a gap therebetween to provide a channel access to the open center of the panel.

7. The closet vault of claim 1 wherein adjacent channel arms are bolted to each other.

8. The closet vault of claim 1 wherein said panels have open opposing ends and connector means sized and shaped to fit into one of the open ends of said panels providing a base attached to said frame.

9. The closet vault of claim 8 further including connector means in the ends of each panel and bolting means bolting the base of each connector means to said frame.

10. The closet vault of claim 1 wherein the free ends of said framing elements have an open channel extending into them and said connector means are sized and shaped to mate with the open channels in the free ends of said framing elements.

11. The closet vault of claim 10 wherein said connector means include a base and legs.

12. The closet vault of claim 11 further including bolting means bolting said base to said frame.

13. The closet vault of claim 11 wherein said legs include bosses and said open channels in said free ends include mating openings with said connector means snapped into the open channels of said free ends of said framing elements to connect said connector means to said framing elements.

14. The closet vault of claim 1 wherein said connector means is C-shaped in cross section.

15. The closet vault of claim 1 further including a door mounted within said door opening.

16. The closet vault of claim 15 further including locking means locking said door whereby intruders from outside the closet are prevented from opening said door.

17. The closet vault of claim 15 wherein said door is connected to said closet vault by a piano hinge.

18. The closet vault of claim 1 further including an electric power outlet provided within the chamber of said closet vault defined by said ceiling, floor and side wall.

19. The closet vault of claim 1 further including a telephone outlet within said chamber.

20. The closet vault of claim 1 wherein said side walls and ceiling are covered with gypsum board.

21. The closet vault of claim 20 wherein said floor is covered with gypsum board.

22. The closet vault of claim 20 wherein said floor is covered with plywood.

23. The closet vault of claim 1 further including means for anchoring said closet vault to an existing structure.

24. The closet vault of claim 1 wherein said multiple framing elements, tube sections, panels and connector means are sized and shaped for packaging and shipment in a compact bundle, the size and shape of which is defined substantially by the size and shape of a single framing element.

25. The closet vault of claim 1 wherein said closet vault has inside dimensions of substantially 7'4" long by 7'4" high and a width in the range of 4' to 7'4".

26. A method of modifying an existing enclosed portion of a building, said enclosed portion having a predetermined size and shape, to provide said enclosed portion of said building with a metal, impact-resistant and fire-retardant enclosure, where said metal enclosure is substantially the same size and shape as the existing enclosed portion of the building and access to said metal enclosure during assembly is possible only from inside the existing enclosed portion of said building, said method including the steps of:

a. from inside the enclosed portion of said building, positioning multiple framing elements having a base and two free ends inside the enclosed portion of said building for assembly;

b. from inside the enclosed portion of said building, connecting the free ends of pairs of said multiple framing elements to form the outline of a frame for said metal enclosure;

c. from inside the enclosed portion of said building, connecting portions of said frame created by the step of the method described in (b) above by attachment of tube sections thereto to complete the assembly of the frame;

d. from inside the enclosed portion of said building, attaching elongated metal panels to said frame in side-by-side, juxtaposed relationship to form a metal ceiling, side walls and floor for said metal enclosure;

e. from inside the enclosed portion of said building, attaching adjacent panels to each other; and f. from inside the enclosed portion of said building, facing the inside of said metal enclosure with fire retardant boards by attaching said boards to the ceiling, side walls and floor thereof.

* * * * *